US009312603B2

(12) United States Patent
Jagielski et al.

(10) Patent No.: US 9,312,603 B2
(45) Date of Patent: Apr. 12, 2016

(54) ON RADIATOR SLOT FED ANTENNA

(71) Applicant: Molex, LLC, Lisle, IL (US)

(72) Inventors: Ole Jagielski, Frederikshavn (DK); Simon Svendsen, Aalborg (DK); Finn Hausager, Aalborg (DK); Morten Christensen, Aalborg (DK)

(73) Assignee: Molex, LLC, Lisle, IL (US)

( * ) Notice: Subject to any disclaimer, the term of this patent is extended or adjusted under 35 U.S.C. 154(b) by 91 days.

(21) Appl. No.: 14/378,124

(22) PCT Filed: Feb. 14, 2013

(86) PCT No.: PCT/US2013/026020
§ 371 (c)(1),
(2) Date: Aug. 12, 2014

(87) PCT Pub. No.: WO2013/123109
PCT Pub. Date: Aug. 22, 2013

(65) Prior Publication Data

US 2015/0015446 A1 Jan. 15, 2015

Related U.S. Application Data

(60) Provisional application No. 61/598,549, filed on Feb. 14, 2012.

(51) Int. Cl.
*H01Q 1/50* (2006.01)
*H01Q 13/10* (2006.01)
(Continued)

(52) U.S. Cl.
CPC ..... *H01Q 13/106* (2013.01); *H01Q 1/38* (2013.01); *H01Q 1/50* (2013.01); *H01Q 1/52* (2013.01); *H01Q 9/40* (2013.01)

(58) Field of Classification Search
CPC ..... H01Q 1/50; H01Q 13/106; H01Q 1/38
USPC ..... 343/767, 700 MS, 702, 725
See application file for complete search history.

(56) References Cited

U.S. PATENT DOCUMENTS 6,573,869 B2 * 6/2003 Moore ..... H01Q 1/243 343/700 MS
7,183,982 B2 * 2/2007 Kadambi ..... H01Q 1/243 343/700 MS (Continued)

FOREIGN PATENT DOCUMENTS

KR 10-0788284 B1 12/2007
TW M336547 U 7/2008
TW 200908445 A 2/2009

OTHER PUBLICATIONS

International Search Report for PCT/US2013/026020.

*Primary Examiner* — Huedung Mancuso
(74) *Attorney, Agent, or Firm* — James A. O'Malley

(57) ABSTRACT

An antenna includes a slot feed on the radiator itself (On Radiator Slot Fed Antenna or ORSFA) instead of the slot feed being a separate element. One of the advantages of having the slot feed integrated onto the radiator is that the antenna is less dependent on the adjacent conductive parts, since the feed is coupling to the radiator rather than to ground (as is done in a standard slot feed antenna concept). The Q of the radiator can also be reduced for a given volume, since the coupler is removed from the antenna volume. In an embodiment the antenna can include a transmission line and an impedance match circuit directly on the radiator.

26 Claims, 7 Drawing Sheets

(51) Int. Cl.

| | |
|---|---|
| ***H01Q 1/38*** | (2006.01) |
| ***H01Q 1/52*** | (2006.01) |
| ***H01Q 9/40*** | (2006.01) |

(56) References Cited

U.S. PATENT DOCUMENTS

| | | | | |
|---|---|---|---|---|
| 7,230,573 | B2 | 6/2007 | Lin et al. | |
| 7,551,142 | B1 | 6/2009 | Zhang et al. | |
| 8,514,132 | B2 * | 8/2013 | Rao | H01Q 1/243 343/700 MS |
| 8,599,086 | B2 | 12/2013 | Wong et al. | |
| 2004/0066345 | A1 | 4/2004 | Schadler | |
| 2006/0208949 | A1 * | 9/2006 | Hirabayashi | H01Q 1/2275 343/702 |
| 2007/0010300 | A1 * | 1/2007 | Xue | H01Q 1/243 455/575.5 |
| 2007/0182658 | A1 * | 8/2007 | Ozden | H01Q 1/243 343/866 |
| 2007/0229370 | A1 * | 10/2007 | Tan | H01Q 1/243 343/702 |
| 2007/0296634 | A1 * | 12/2007 | Popugaev | H01Q 9/0414 343/700 MS |
| 2009/0109096 | A1 * | 4/2009 | Hozouri | H01Q 9/0421 343/700 MS |
| 2010/0085262 | A1 | 4/2010 | Wolf | |
| 2012/0229360 | A1 | 9/2012 | Jagielski et al. | |

* cited by examiner

ON RADIATOR SLOT FED ANTENNA

RELATED APPLICATIONS

This application claims priority to U.S. Provisional Application No. 61/598,549, filed Feb. 14, 2012, which is incorporated herein by reference in its entirety.

FIELD OF THE INVENTION

The present invention relates to the field of antennas, more specifically to the field of antennas suitable for use in compact devices.

DESCRIPTION OF RELATED ART

Antennas are a challenging element to provide in a communication system. On the one hand it is desirable to make the antenna very small. On the other hand, resonance of the antenna is related to the size and there are limits to how small an antenna can be and still provide acceptable performance.

Slot fed antennas are known and an embodiment of a slot-fed antenna is described in PCT Application No. PCT/US10/47978, which is incorporated herein by reference in its entirety. The slot-fed antenna attempts to address some of the problems with prior antenna designs by providing more bandwidth for a given volume of antenna. While the slot-fed antenna design has certain advantages, it is somewhat dependent on adjacent conductive parts and the ground plane is used as part of the circuit. Certain applications and package configurations are less suitable to such a design but still would benefit from improved bandwidth for a given radiator size. Thus, certain individuals would appreciate further improvements in antenna design.

BRIEF SUMMARY

This disclosure demonstrates very compact antenna designs which can be used in highly capacitive loaded environment like devices with metal covers. The concept can be used as a single resonance antenna for GPS and Bluetooth applications or as multi resonance antennas like WiFi and cellular systems by combining several ORSFA elements.

In an embodiment, a radiating element is coupled to ground on a first end and a second end is separated from ground. The radiating element includes a slot with a first side and a second side, the slot positioned between the first and second end with the first side facing the first end and the second side facing the second end. A feed is coupled to the slot on the second side.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

The description that follows illustrates novel techniques for integrating a slot feed on an antenna onto the radiator itself (On Radiator Slot Fed Antenna or ORSFA), and not as a separate element as described in PCT Application No. PCT/US10/47978, which is incorporated herein by reference in its entirety. One of the advantages of having the slot feed integrated onto the radiator is that the antenna is less dependent on the adjacent conductive parts, since the feed is only coupling to the radiator and not also to the ground as in the standard slot feed antenna concept. The Q of the radiator is also reduced for a given volume, since the coupler is removed from the antenna volume, so that the capacitive coupling of the radiator can be reduced. In an embodiment the antenna can include a transmission line and an impedance match on the radiator itself.

Figure 1:
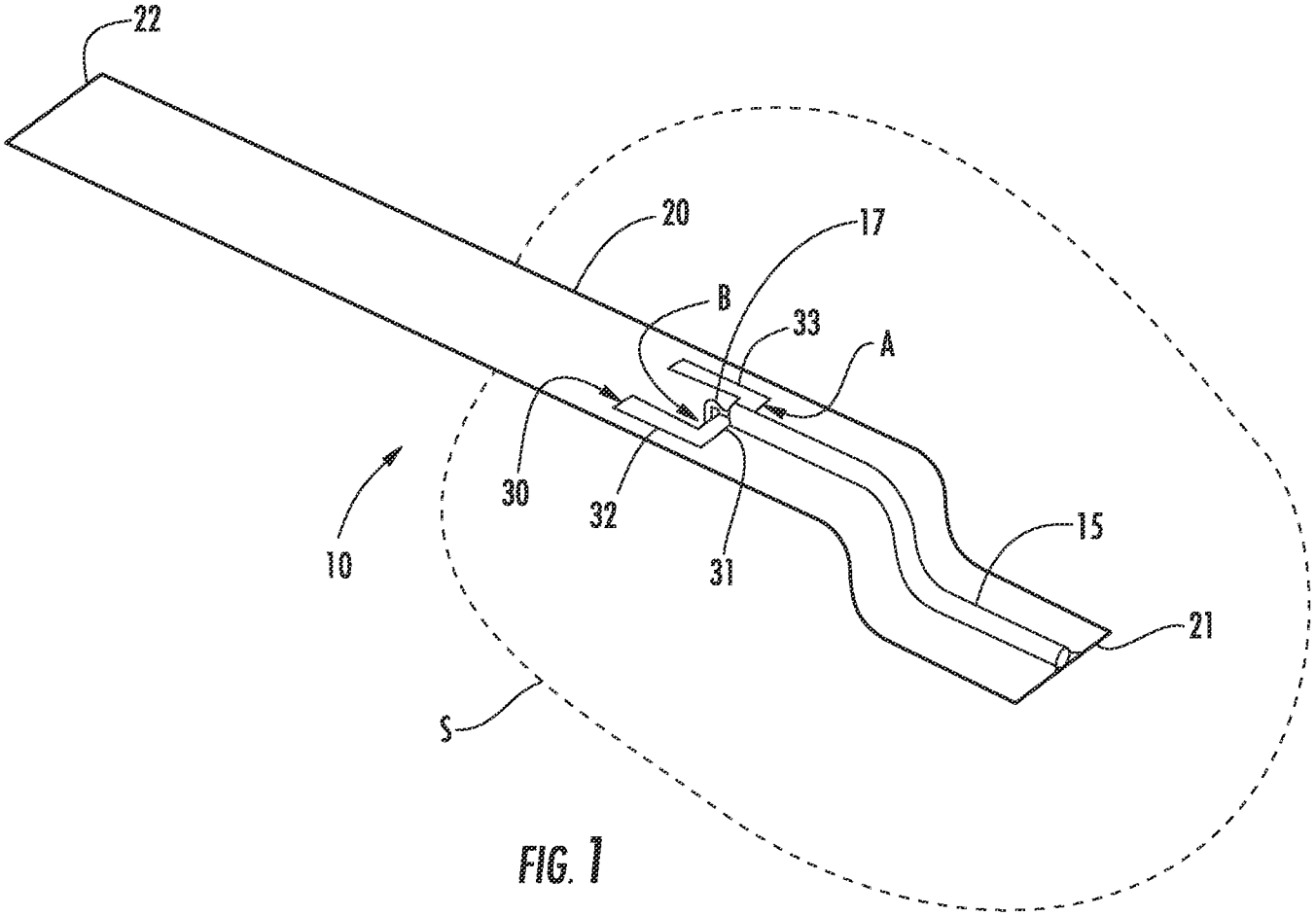
FIG. 1 illustrates a perspective view of an embodiment of an antenna configuration.

FIG. 1 illustrates an embodiment of an antenna 10 extending from a ground plane S. The antenna 10 includes a radiator 20 with a first end 21 and a second end 22. The first end 21 is connected to the ground plane S and the second end 22 is not electrically connected to the ground plane S. A slot 30 is provided that includes a first side A (facing the first end 21) and a second side B (facing the second end 22). As depicted, the slot 30 has a base 31 and a first leg 32 and a second leg 33. The length of the legs 32, 33 allows the distance around the slot 30 to be tuned as desired. A feed is directly connected to the second side B of the slot 30 by a conductor 17 that extends from a coax cable 15. Thus, the on-radiator feed can be provided as depicted in FIG. 1, where a coax cable 15 is used to feed across a slot 30 on the radiator 20 (indirect feed). The radiator 20 itself can be designed in a conventional manner so as to be in resonance at the desired frequency and the indirect slot feed is used to create a Chebyshev-like match so that the available impedance bandwidth is increased. The position, size and shape of the slot 30 are used to define the additional Chebyshev match, as is further described below. Thus, the antenna 10 depicted in FIG. 1 illustrates an on-radiator, slot-fed antenna (hereinafter an "ORFSA").

As depicted, the radiator 20 is positioned on an infinite ground plate (illustrated by ground plane S) and has a well-defined connection between the radiator 20 and the ground plane S. However, in practice the ground plane S could have any size and shape, and the radiator 20 could be positioned anywhere on the ground plane S.

Figure 2:
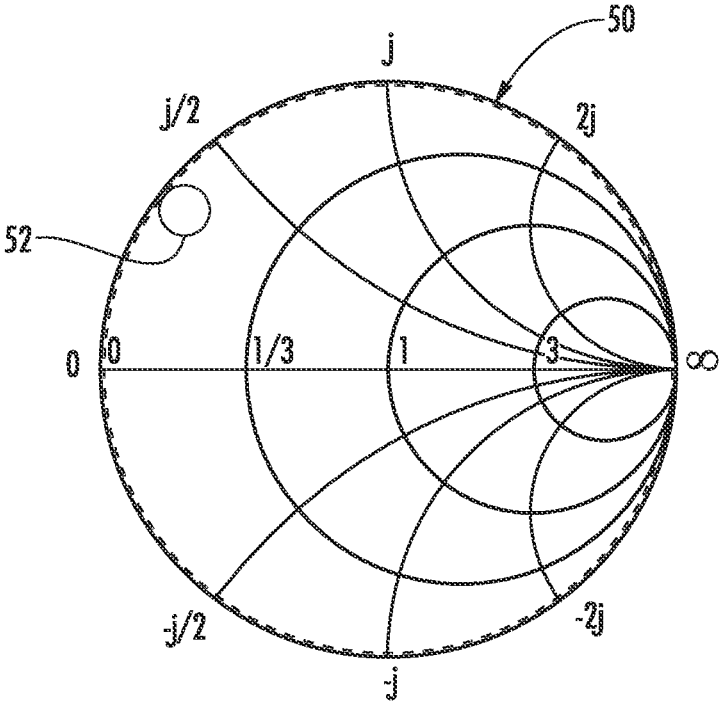
FIG. 2 illustrates an impedance plot of an antenna on a Smith chart.
Figure 3:
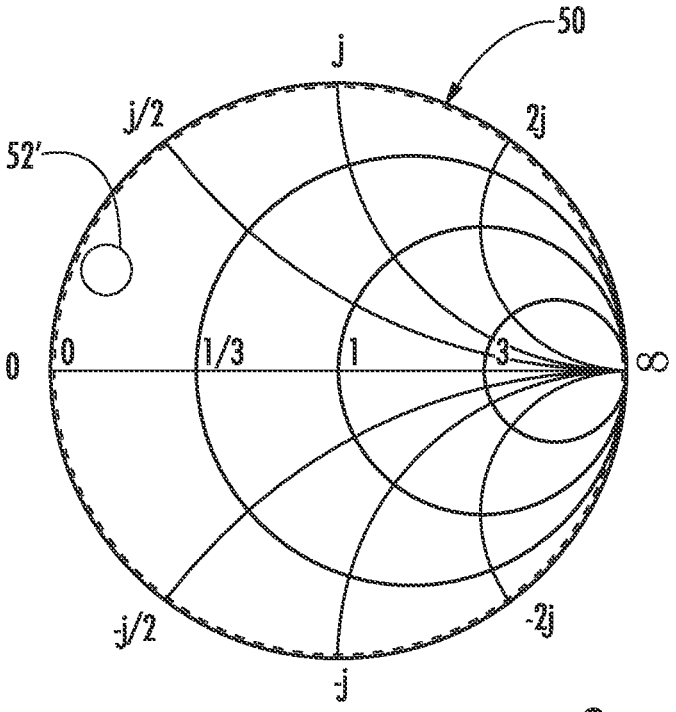
FIG. 3 illustrates an impedance plot of an antenna on a Smith chart.
Figure 4:
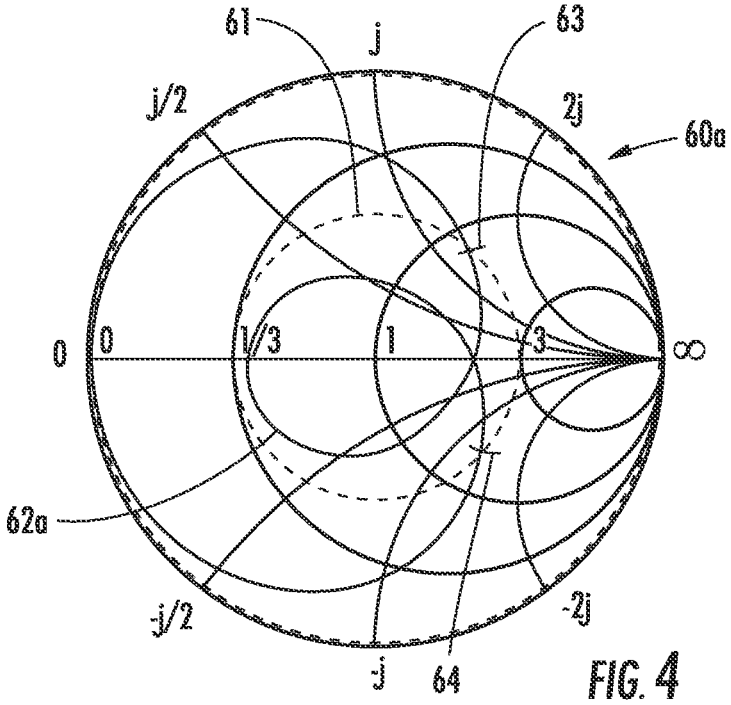
FIG. 4 illustrates an impedance plot of an antenna on a Smith chart.

The unmatched complex impedance of the basic ORSFA is shown in FIG. 2. As depicted, the Smith chart 50 includes a curl 52. The small curl 52 is the Chebychev like match created by the indirect slot feed. The size of the curl 52 is controlled by the physical size and shape of the slot 30. A higher coupling (larger curl) is achieved by moving the slot 30 closer to the first end 21 of the radiator 20 (e.g., closer to the ground connection of the radiator 20) or by increasing the size of the slot 30. The phase delay of the curl 52 (the position in the Smith chart) is also an important factor, since this determines the topology of the needed matching circuit and the values of the components. In order to maximize the antenna impedance bandwidth it is desired to keep the phase delay as small as possible, which is somewhat contradictory with keeping the matching circuit simple. An acceptable compromise for the ORSFA depicted in FIG. 1 is to design for a phase delay, allowing for a 50Ω match, by using a parallel capacitor. The result of using a parallel capacitor is shown in FIG. 3. As can be appreciated, the phase delay is primarily controlled by the size and shape of the slot 30 or by discrete components. The adjustment of the resonance depicted in FIG. 3 was done with a series capacitor for convenience rather than using a different size slot; however, the phase optimization can also be done by adjusting the slot 30. If possible, adjustment by varying the slot 30 is preferred because it will reduce the number of discrete components used and thereby reduce the complexity and bill of material. The final step is to match the curl 52 to 50Ω using a parallel capacitor, the result of which is shown in FIG. 4, where impedance curve 62*a* has a first frequency 63 and a second frequency 64 that are about 98 MHz apart (the two frequencies representing the entrance and exit of the standing wave reflection (SWR) circle=3:1. The compares with the impedance curve 62*b* in FIG. 5, where the impedance curve 62*b* has a frequency 65 and a frequency 66 (the two are about 40 MHz apart) representing when the impedance curve enters and exits the SWR=3 circle. These values are provided below in Table 1.

Figure 5:
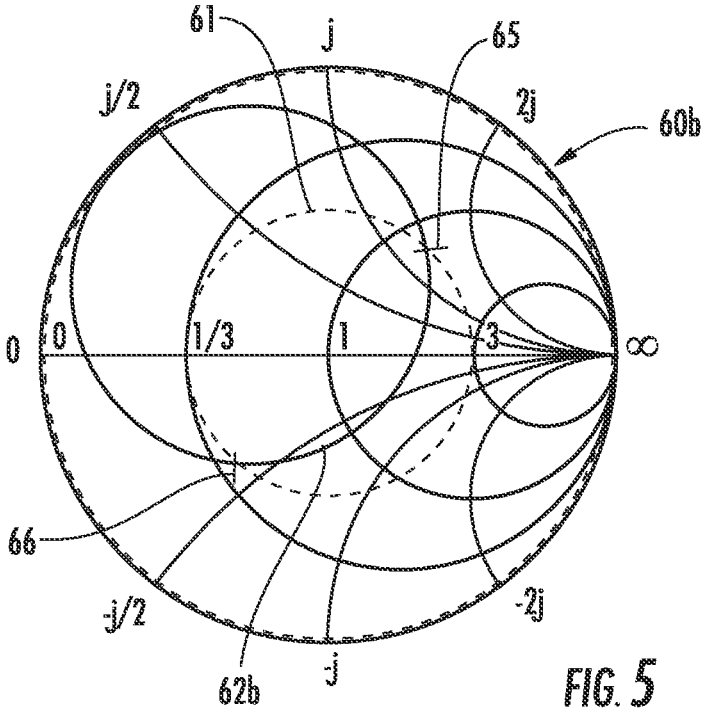
FIG. 5 illustrates an impedance plot of an antenna on a Smith chart.

It can be appreciated that the impedance characteristic of the matched ORSFA is very similar to that of a Chebyshev match, which helps contribute to the improved impedance bandwidth. The impedance of the same element, but fed with a standard direct feed, is shown in FIG. 5. In that example, the match was provided by a series inductor, followed by a parallel inductor. The obtained impedances between the slot-fed feeding technique and the standard direct feed technique is summarized in Table 1:

TABLE 1

| | Bandwidth Frequencies at SWR = 3 | | | |
|---|---|---|---|---|
| | Start | Stop | Bandwidth | Bandwidth |
| High impedance slot feed | 820 MHz | 990 MHz | 98 MHz | 10.7% |
| Standard direct feed | 893 MHz | 933 MHz | 40 MHz | 4.4% |
| Improvement | | | 58 MHz | 143% |

The available impedance bandwidth is increased from 40 MHz to 98 MHz using the same element on identical ground planes, but feeding them differently. An increase in impedance bandwidth of 143% is observed for this configuration in a lossless environment. A similar result is expected for a lossy environment, since the Q of the element is identical and the coupling slot is not radiating at the element resonance frequency but instead is a very high Q $2^{nd}$ order matching circuit.

Figure 6:
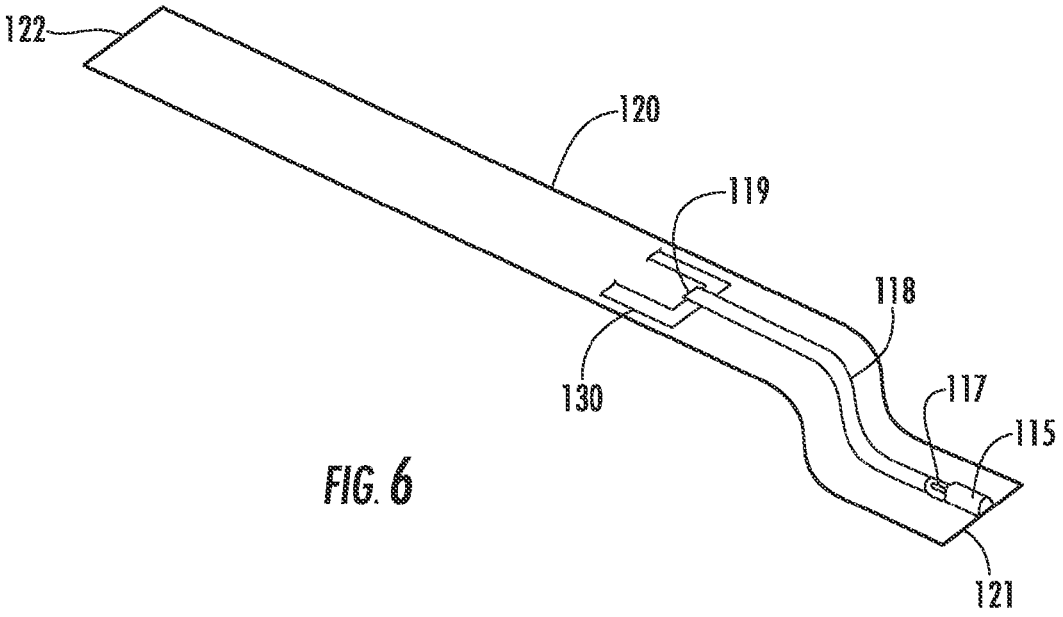
FIG. 6 illustrates a perspective view of an embodiment of an antenna configuration.

While providing acceptable performance, feeding the radiator with a coax cable may not always be a practical solution from a packaging standpoint. This is because the coax cable occupies space and could be difficult to mount in certain applications. An easier to package solution is to combine a microwave transmission line on the radiator with a coax cable, as depicted in FIG. 6. In this configuration a coax cable 115 with a conductor 117 is connected at the first end of a flex PCB 120 with the conductor electrically connected to a microwave transmission line 118 that is used to feed across the slot 130 via line end 119 (which as depicted in FIG. 6 is a direct coupling).

Figure 7:
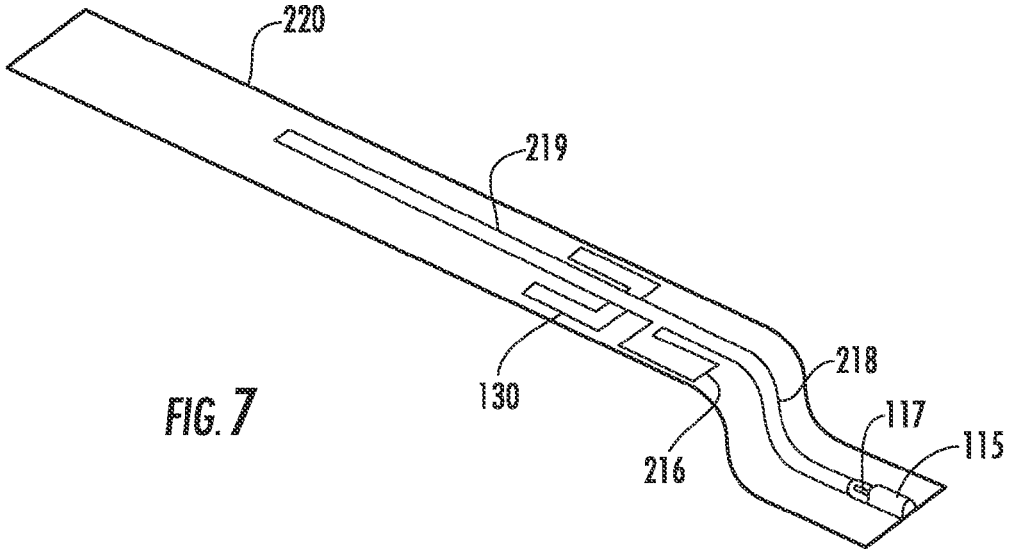
FIG. 7 illustrates a perspective view of an embodiment of an antenna configuration.
Figure 8:
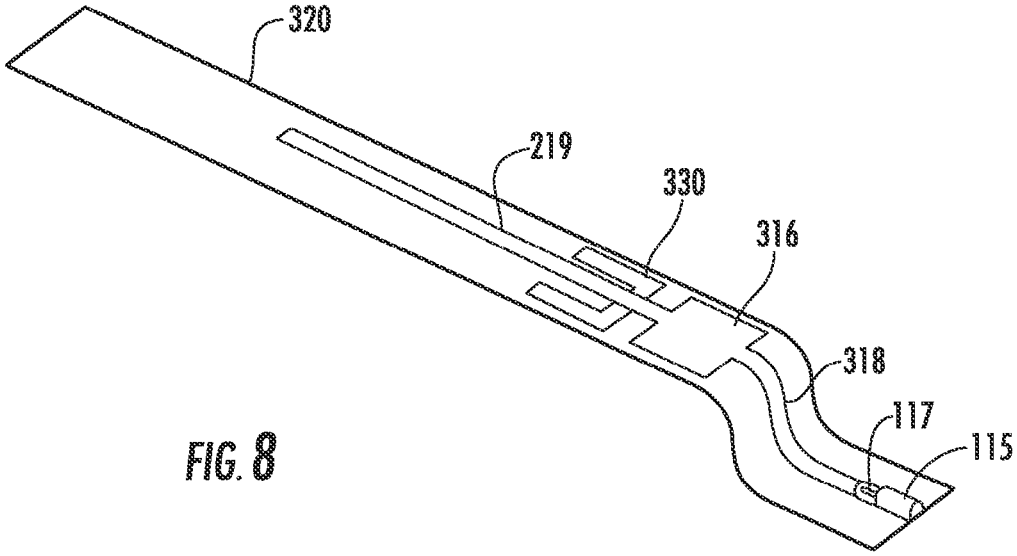
FIG. 8 illustrates a perspective view of an embodiment of an antenna configuration.

One disadvantage of using a transmission line on the radiator is that a double side flex PCB with vias is best suited for such a design (which may tend to increase the cost of the solution). However, having a double side Flex PCB makes it possible to substitute the discrete matching component with microwave stubs, low impedance transmission lines and on PCB capacitors as shown in FIGS. 7 and 8. It should be noted that the transmission line is depicted as being implemented with a microstrip line. However, if the flex PCB has more than 2 layers, it is also possible to use a stripline instead of a microstrip line.

Specifically, FIG. 7 illustrates a radiator 220 that can be formed of a flex PCB and includes a slot 130 (which is sized as desired). A coax cable 115 includes a conductor 117 that is electrically connected to transmission line 218 which includes an open stub 219 that couples to the radiator 220 (thus providing an indirect coupling rather than having a direct electrical connection as is depicted in FIG. 6). A parallel capacitor 216 is used to help match the impedance of the transmission line 218 to the desired 50 ohms.

The λ/4 wave open stub is equivalent to a series capacitor and is used to control the position and size of the curl. Increasing the length of the open stub to more than a λ/4 wave will shift the curl clockwise in the Smith chart, while reducing the length will shift it counter clockwise. The width of the λ/4 wave open stub can be used to tune the size of the curl without affecting the phase delay and a wider open stub will increase the size of the curl.

FIG. 8 illustrates an embodiment of antenna that has a radiating element 320 that supports a transmission line 318 that is connected at one end to the conductor 117 of the coax cable 115. The transmission line 318 includes a stub 319 that couples indirectly to the radiating element 320 on the second side of a slot 330. As discussed above, the dimensions of the stub 319 can be adjusted as appropriate. The transmission line 318 further includes a low impedance area 316 that emulates a parallel capacitor. As can be appreciated, the use of the open stub 319 controls phase delay while the low impedance area 316 can provide the desired 50 ohms match.

Figure 9:
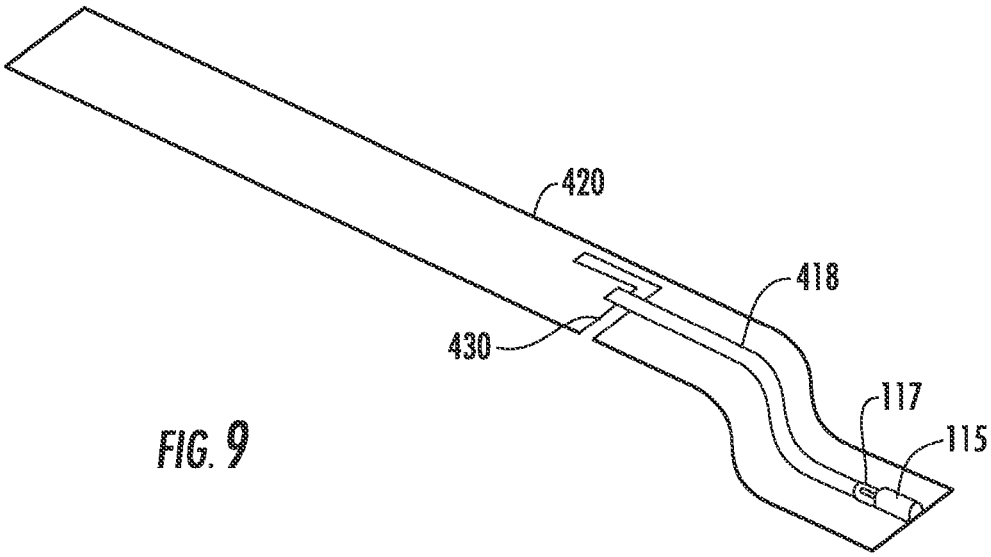
FIG. 9 illustrates a perspective view of an embodiment of an antenna configuration.

The above illustrated slot feeds configurations are all closed slot Low Impedance Slot Feed (LISF) embodiments, similar to what is described in PCT Application No. PCT/US10/47978. However, an open slot LISF configuration could also be used, as is depicted in FIG. 9. The open slot LISF's can have any shape and be placed anywhere on the radiator, the size and position having the affects discussed above. As can be appreciated, therefore, a radiator could include any combination of an open or closed slot and a directly or indirectly coupled transmission line.

Figure 10:
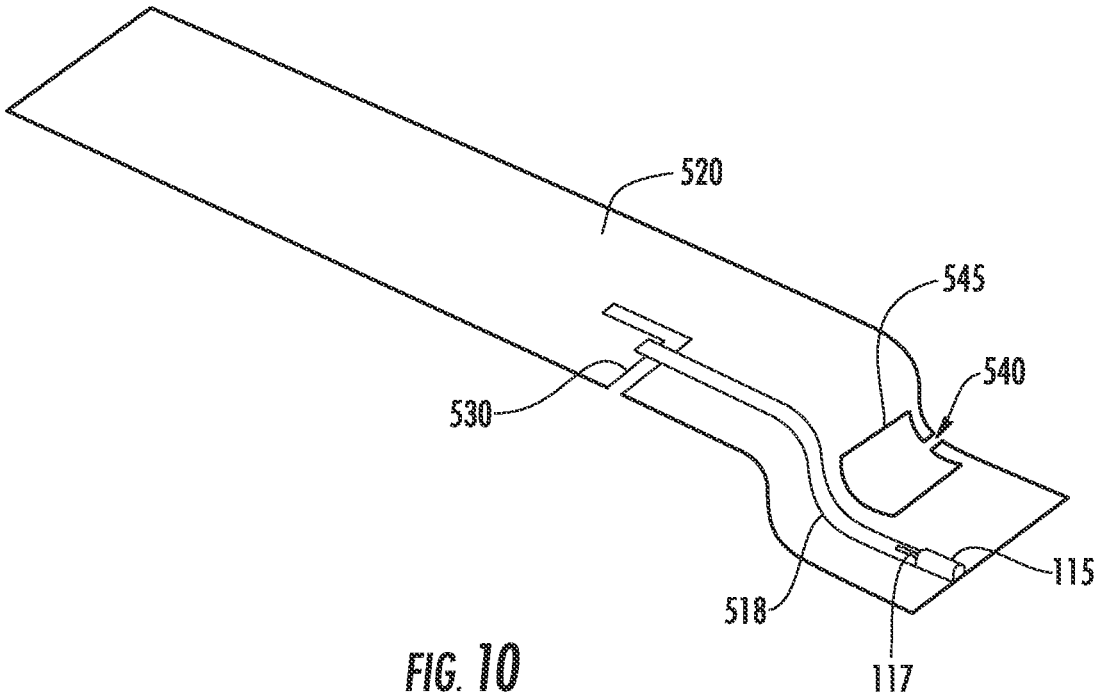
FIG. 10 illustrates a perspective view of an embodiment of an antenna configuration.

As is known, the resonance frequency of the radiator is determined by its length, which could be a problem for certain applications, particularly where the space allocated for the antenna is too small to allow a resonance at a desired frequency. The resonance frequency of the radiator 520 can be changed/tuned by adding a tuning circuit, as shown in FIG. 10. The radiator 520 includes a slot 530 with a conductor 117 from a coax cable 115 connected to a transmission line 518 that is directly coupled across the slot 530 (as opposed to using the stub 219 depicted in FIG. 7). A tuning circuit, as depicted, consists of a cutout 545 and a capacitor 540 that is positioned in the gap formed in the radiator 520.

The depicted tuning circuit consists of a capacitor across a cutout in the radiator, forming a parallel resonance circuit. In such a configuration, the inductor (determined by the cutout) is fixed, but the characteristics of the parallel resonator can be changed by adjusting the capacitance. The capacitor 540 could be a discrete component or implemented in the flex itself. In addition, using a tunable capacitor 540 (e.g., one that can be varied in response to a signal provided by a controller) will allow for a tunable antenna system which could be operated in either a closed or open feedback loop configuration.

Figure 11:
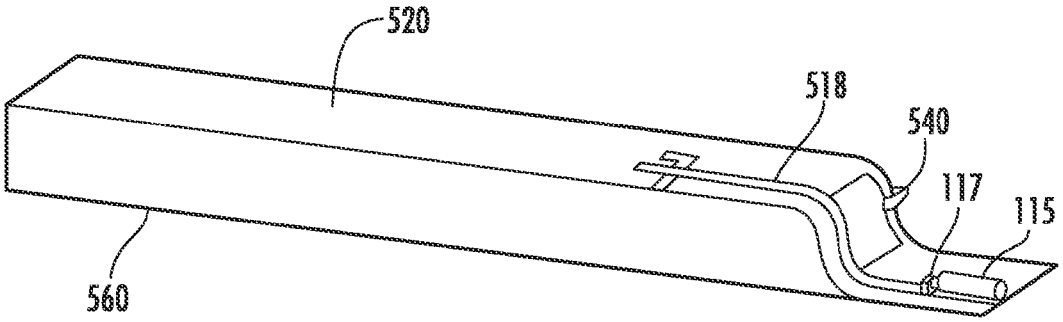
FIG. 11 illustrates a perspective view of an embodiment of an antenna configuration.
Figure 12:
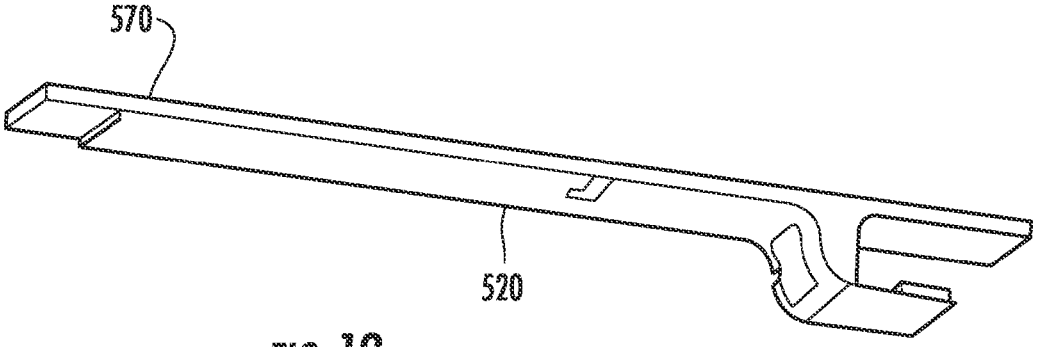
FIG. 12 illustrates a perspective view of an embodiment of an antenna configuration.

Having majority of the antenna structure and matching circuit implemented on a flex PCB enables the option to move the coax away from the feed area. This leads to an antenna solution where the radiator 520 (which can be the same as in the antenna depicted in FIG. 10) can be mounted on a traditional carrier 560, as show in FIG. 11 or on the inside of a cover/housing 570, as shown in FIG. 12. As can be appreciated, the antenna only needs one connection between the antenna flex PCB and the chassis of the device, thus providing substantial design flexibility. Another advantage of mounting the flex PCB on the inside of a cover or housing part is that the high electromagnetic fields between the radiator and the chassis ground are coupled through air rather than some potentially more lossy carrier material, thereby improving the radiated performance of the antenna.

The above mention exampled are all single resonance antenna configurations. However, it is possible to combine individual ORSFA's to cover multiple frequency ranges, either as a multiple feed or single feed configuration. A multiple feed configuration uses a certain number of ORSFA configurations each fed individually from the RF frontend. Good impendance isolation is desirable between all of the ORAFA's in order to avoid an undesirable coupling loss.

A combing network is useful to implement a single feed multiple frequency range antenna system using ORSFA's. The combining network increases the isolation between the ORSFA's seen from the RF frontend, which is used to maintain the individual impedance bandwidths of the ORSFA's. Coupling loss is not an issue for the single feed configuration and the requirements for the impedance isolation between the individual elements is less than a multiple feed configuration. However, good impedance isolation is still desirable, since it will make the tuning of the ORSFA's easier. The combining network can include a desired combination of discrete components, microwave stubs and transmission lines.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. An antenna comprising:

a radiating element having a first end and a second end, the first end configured to be connected to a reference voltage plane and the second end not electrically connected to the reference voltage plane;

a slot in the radiating element, the slot having a first side and a second side and positioned between the first end and the second end, the first side facing the first end and the second side facing the second end; and a feed coupled to the second side of the slot, wherein the feed is a transmission line positioned on the radiating element, and wherein the transmission line is coupled to the second side via an open-ended stub, the stub having a length approximately equal to a $\lambda/4$ wave length.

2. The antenna of claim 1, wherein the transmission line includes a low impedance portion positioned between the first end and the second side of the slot.

3. The antenna of claim 1, wherein the transmission line includes a parallel capacitor formed by a stub extending off the transmission line between the first end and the second side of the slot.

4. An antenna for use in connection with a separate ground plane, the antenna comprising:

a radiating element, the radiating element having first and second opposite surfaces, first and second opposite ends, and a slot, wherein one of the first and second opposite surfaces is configured to be positioned on the separate ground plane, wherein the first end is electrically connected to the separate ground plane and the second end of the radiating element is not electrically connected to the separate ground plane, and wherein the slot is provided through the radiating element from the first surface to the second surface, the slot being positioned between the first and second opposite ends, the slot having first and second opposite sides, the first side facing the first end, the second side facing the second end; and a feed line, the feed line providing an electrical connection to the radiating element, the feed line providing an indirect feed as the feed line extends across the slot and along one of the first and second opposite surfaces to the first end.

5. The antenna as defined in claim 4, wherein the feed line provides a direct electrical connection to the radiating element at the second side of the slot.

6. The antenna as defined in claim 5, wherein the feed line includes a conductor and a coax cable, the conductor is directly electrically connected to the radiating element at the second side of the slot, the conductor extends from the coax cable, the coax cable extends across the slot and along one of the first and second opposite surfaces to the first end.

7. The antenna as defined in claim 5, wherein the feed line includes a transmission line, a conductor and a coax cable, the coax cable and the conductor being connected at the first end, the conductor being electrically connected to the transmission line, the transmission line extending along one of the first and second opposite surfaces and extending across the slot, the transmission line being directly electrically connected to the radiating element at the second side of the slot.

8. The antenna as defined in claim 7, wherein the transmission line is a microwave transmission line.

9. The antenna as defined in claim 7, wherein the antenna further comprises a tuning circuit.

10. The antenna as defined in claim 9, wherein the tuning circuit includes a cutout and a capacitor, the cutout being formed through the radiating element between the slot and the first end, the capacitor being positioned in the cutout.

11. The antenna as defined in claim 4, wherein the feed line provides an indirect electrical connection to the radiating element between the second side of the slot and the second end.

12. The antenna as defined in claim 11, wherein the feed includes a transmission line having an open stub, a conductor and a coax cable, the coax cable and the conductor being connected at the first end, the conductor being electrically connected to the transmission line opposite the open stub, the transmission line extending along one of the first and second opposite surfaces and extending across the slot, the open stub extending further toward the second end, the open stub being coupled to the radiating element.

13. The antenna as defined in claim 12, wherein the open stub is a $\lambda/4$ wave open stub.

14. The antenna as defined in claim 12, wherein the feed further includes a parallel capacitor.

15. The antenna as defined in claim 14, wherein the parallel capacitor extends from the transmission line between the first end and the first side of the slot.

16. The antenna as defined in claim 12, wherein the transmission line further includes a low impedance area.

17. The antenna as defined in claim 16, wherein the low impedance area is positioned between the first end and the first side of the slot.

18. The antenna as defined in claim 4, wherein the first surface of the radiating element is positioned on the separate ground plane, and wherein the feed line extends along the second surface to the first end.

19. The antenna as defined in claim 4, wherein the first surface of the radiating element is positioned on the separate ground plane, and wherein the feed line extends along the first surface to the first end.

20. The antenna as defined in claim 4, wherein the slot is a closed slot.

21. The antenna as defined in claim 20, wherein the slot has a base and a pair of legs extending from the base such that the slot is generally U-shaped in configuration.

22. The antenna as defined in claim 21, wherein the legs extend from the base toward the second end.

23. The antenna as defined in claim 4, wherein the slot is an open slot.

24. The antenna as defined in claim 23, wherein the slot has a base and a single leg extending from the base such that the slot is generally L-shaped in configuration.

25. The antenna as defined in claim 24, wherein the leg extends from the base toward the second end, and wherein the base provides the opening of the slot.

26. The antenna as defined in claim 4, wherein the radiating element is a flex printed circuit board.

* * * * *